US009981163B2

(12) United States Patent
Wada et al.

(10) Patent No.: US 9,981,163 B2
(45) Date of Patent: May 29, 2018

(54) GOLF CLUB HEAD

(71) Applicant: Bridgestone Sports Co., Ltd., Tokyo (JP)

(72) Inventors: Kozue Wada, Tokyo (JP); Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days. days.

(21) Appl. No.: 15/217,597

(22) Filed: Jul. 22, 2016

(65) Prior Publication Data

US 2017/0128789 A1 May 11, 2017

(30) Foreign Application Priority Data

Nov. 10, 2015 (JP) ..... 2015-220508

(51) Int. Cl.
*A63B 53/04* (2015.01)
*A63B 53/06* (2015.01)

(52) U.S. Cl.
CPC .. *A63B 53/0466* (2013.01); *A63B 2053/0408* (2013.01); *A63B 2053/0491* (2013.01)

(58) Field of Classification Search
CPC ..... A63B 53/0466; A63B 2053/0491; A63B 2053/0408
USPC ..... 473/324–350, 287–292
See application file for complete search history.

(56) References Cited

U.S. PATENT DOCUMENTS 2,056,335 A * 10/1936 Wettlaufer ..... A63B 53/08 473/245
4,867,458 A * 9/1989 Sumikawa ..... A63B 53/04 473/336
4,869,507 A * 9/1989 Sahm ..... A63B 53/04 473/337
5,447,309 A * 9/1995 Vincent ..... A63B 53/04 473/335
5,582,553 A * 12/1996 Ashcraft ..... A63B 53/04 473/338
6,254,494 B1 * 7/2001 Hasebe ..... A63B 53/04 473/345
6,471,604 B2 * 10/2002 Hocknell ..... A63B 53/02 473/334
6,991,558 B2 * 1/2006 Beach ..... A63B 53/04 473/324
7,147,573 B2 * 12/2006 DiMarco ..... A63B 53/0466 473/324

(Continued)

FOREIGN PATENT DOCUMENTS

JP 2006-187489 A 7/2006
JP 2010-136772 A 6/2010

*Primary Examiner* — Sebastiano Passaniti
(74) *Attorney, Agent, or Firm* — Muncy, Geissler, Olds & Lowe, P.C.

(57) ABSTRACT

A golf club head comprises two weight members, and in a reference plan view where a sole part faces upward and a hosel hole central axis extension line is vertical, a reference imaginary straight line, a first imaginary straight line and a second imaginary straight line are set. The reference imaginary straight line passes through a central axis of a hosel hole and a head gravity center is determined when weight members are not attached. The first imaginary straight line passes through the central axis of the hosel hole and a center of the first opening part. The second imaginary straight line passes through the central axis of the hosel hole and a center of the second opening part. A first angle $\theta_1$ between the reference and first imaginary straight lines is ±10 degrees or less, and a second angle $\theta_2$ between the reference and second imaginary straight lines is larger than the first angle $\theta_1$.

8 Claims, 6 Drawing Sheets

(56) References Cited

U.S. PATENT DOCUMENTS

| | | | | |
|---|---|---|---|---|
| 7,186,190 | B1 * | 3/2007 | Beach | A63B 53/0466 473/335 |
| 7,198,575 | B2 * | 4/2007 | Beach | A63B 53/04 473/324 |
| 7,377,860 | B2 * | 5/2008 | Breier | A63B 53/0466 337/345 |
| 7,611,424 | B2 * | 11/2009 | Nagai | A63B 53/0466 473/334 |
| 8,388,465 | B2 * | 3/2013 | De La Cruz | A63B 53/0466 473/334 |
| 8,485,919 | B2 * | 7/2013 | Rice | A63B 53/0466 473/334 |
| 8,550,935 | B2 * | 10/2013 | Stites | A63B 53/0466 473/324 |
| 8,696,488 | B2 * | 4/2014 | Burnett | A63B 53/02 473/246 |
| 2008/0096688 | A1 * | 4/2008 | Yokota | A63B 53/0466 473/345 |
| 2008/0132353 | A1 * | 6/2008 | Hsiao | A63B 53/0466 473/336 |
| 2010/0144461 | A1 * | 6/2010 | Ban | A63B 53/0466 473/338 |
| 2010/0167837 | A1 * | 7/2010 | Ban | A63B 53/0466 473/336 |
| 2013/0150180 | A1 * | 6/2013 | Yamamoto | A63B 53/0466 473/339 |
| 2014/0187347 | A1 * | 7/2014 | Yamamoto | A63B 53/04 473/335 |

* cited by examiner

GOLF CLUB HEAD

CROSS REFERENCE TO RELATED APPLICATIONS

This application claims priority under 35 USC 119 to Japanese Patent Application No. 2015-220508 filed on Nov. 10, 2015, the entire contents which are incorporated herein by reference.

TECHNICAL FIELD

The present invention relates to a golf club head, more particularly, to a hollow golf club head.

BACKGROUND

As a wood type golf club head such as a driver or a fairway wood, a hollow metallic golf club head is widely used. In general, a hollow wood type golf club head has a face part for hitting a ball, a crown part that forms an upper surface part of the golf club head, a sole part that forms a bottom surface part of the golf club head, a side part that forms side surface parts of a toe side, a back side and a heel side of the golf club head, and a hosel part. A shaft is inserted into the hosel part and is fixed thereto using an adhesive or the like. Recently, many golf clubs referred to as utility clubs are commercially available. As one type of the utility golf clubs, various golf clubs that each have a hollow head similar to the above-described wood type golf club head (that is, a head that has a face part, a sole part, a side part, a crown part and a hosel part) are commercially available.

When a position of a weight member that is provided in the hollow golf club head is changed, a gravity center position of the golf club head is changed. When the gravity center position is changed, characteristics of the golf club head are changed, for example, a height and a lateral direction of a trajectory of a hit ball, operability, ball catchability and the like are changed.

Patent Document 1 discloses a golf club head in which a position of a weight member is changeable. By changing the position of the weight member, while a change in ball catchability is reduced as much as possible, other characteristics of the golf club head can be changed. The golf club head includes a head main body, the weight member that is attached to the head main body, and a fixing means that fixes the weight member to one of a plurality of attachment positions of the head main body. In the golf club head, the plurality of the attachment positions are positioned on a plane that includes a gravity center position of the head main body in a state where the weight member is not attached and axis of a shaft that is mounted to the golf club head.

Patent Document 2 discloses a golf club head in which a large number of tubular weight attachment parts that each allow a weight for weight balance adjustment to be replaceably attached are provided on a wall surface of the golf club head.

RELATED DOCUMENTS

[Patent Document 1] Japanese Patent Laid-Open Publication No. 2010-136772.

[Patent Document 2] Japanese Patent Laid-Open Publication No. 2006-187489.

The present invention is intended to provide a golf club head that allows a gravity center angle to be adjusted while a head weight can be maintained.

SUMMARY

A golf club head disclosed in the application comprises a head main body that includes: a hosel hole; a first attachment part that has a first opening part for allowing a weight member to be removably attached thereto; and a second attachment part that has a second opening part for allowing a weight member to be removably attached thereto; two or more of first weight members that have different weights and can each be attached to the first attachment part; and two or more of second weight members that have different weights and can each be attached to the second attachment part. Wherein there are two or more of combinations each of which includes one of the first weight members and one of the second weight members, and has the same total weight, in a reference plan view where a sole part faces upward and a hosel hole central axis extension line is vertical, a reference imaginary straight line, a first imaginary straight line and a second imaginary straight line are set, the reference imaginary straight line passing through a central axis of the hosel hole and a head gravity center that is determined when weight members are not attached, the first imaginary straight line passing through the central axis of the hosel hole and a center of the first opening part, and the second imaginary straight line passing through the central axis of the hosel hole and a center of the second opening part, a first angle $\theta_1$ between the reference imaginary straight line and the first imaginary straight line is ±10 degrees or less, and a second angle $\theta_2$ between the reference imaginary straight line and the second imaginary straight line is larger than the first angle $\theta_1$.

It is preferred that the second angle $\theta_2$ is 50 degrees or more and 90 degrees or less.

Further, it is preferred that a difference (e-f) between distance (e) and distance (f) is 15 mm or less, the distance (e) being defined as, in a face-back direction, from the head gravity center to the center of the first opening part and the distance (f) being defined as, in the face-back direction, from the head gravity center to the center of the second opening part, and a difference (g-h) between distance (g) and distance (h) is 15 mm or less, the distance (g) being defined as, in a toe-heel direction, from the head gravity center to the center of the first opening part and the distance (h) being defined as, in the toe-heel direction, from the head gravity center to the center of the second opening part.

To describe a reference plan view in the present invention with reference to a drawing, as illustrated in FIG. 11, the reference plan view is a plan view when a sole part 3 of a golf club head 1 faces upward and a central axis extension line a of a hosel hole 6*a* of a hosel part 6 is vertical. The plan view represents a state where, in the state of FIG. 11, the golf club head 1 is viewed downward from a position vertically above the golf club head 1 as indicated by arrow Eye.

In the golf club head of the present invention, by having the at least two combinations having the same total weight of one first weight member that is attached to the first attachment part and one second weight member that is attached to the second attachment part, the gravity center angle can be adjusted while the head weight can be maintained.

DETAILED DESCRIPTION OF EMBODIMENT(S)

Figure 1:
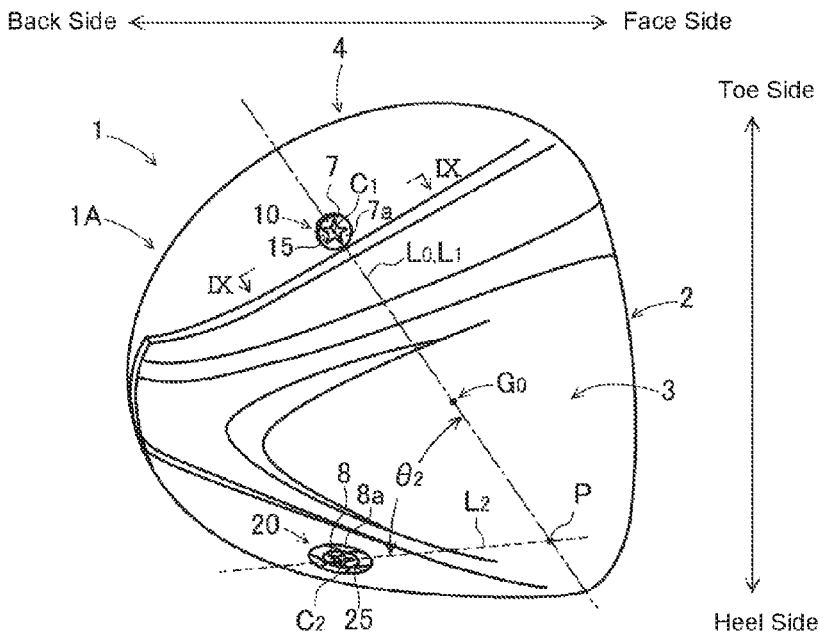
FIG. 1 is a reference plan view of a sole part of a golf club head according to an embodiment.

In the following, with reference to FIGS. 1-10, a golf club head according to an embodiment is described.

A golf club head 1 illustrated in FIGS. 1-10 is a hollow driver head. A head main body 1A of the golf club head 1 has a face part 2, a sole part 3, a side part 4, a crown part 5 and a hosel part 6. In this embodiment, the head main body 1A is integrally formed of a metal. Examples of the metal include titanium, titanium alloy, aluminum alloy, stainless steel and the like. However, the titanium alloy is preferable. A portion of the golf club head 1 may be formed of a non-metallic material such as a fiber reinforced resin. Further, on a portion of the golf club head 1, such as the sole part or the side part, a decorative member or a nameplate, made of a synthetic resin, a rubber, an elastomer, or the like, may be provided.

The face part 2 is a surface for hitting a ball. The sole part 3 forms a bottom surface part of the golf club head, and the crown part 5 forms an upper surface part of the golf club head. The side part 4 connects the sole part 3 and the crown part 5, and extends from a toe side through a back side to a heel side. The hosel part 6 has a hosel hole 6*a*, and a shaft is fixed to the hosel hole 6*a*.

On the sole part 3 of the head main body 1A, on the toe side, a first attachment part 10 is provided; and on the heel side, a second attachment part 20 is provided. The golf club head 1 has a first weight member 7 that is removably attached to the first attachment part 10, and a second weight member 8 that is removably attached to the second attachment part 20.

Figure 9:
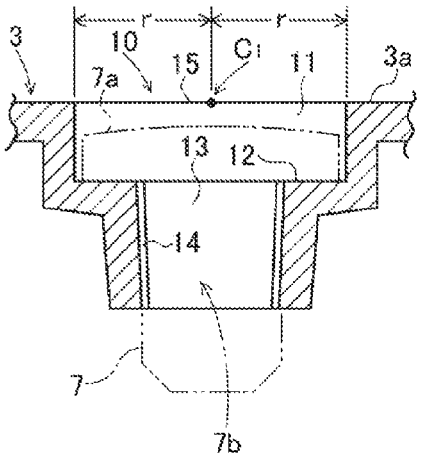
FIG. 9 is an enlarged cross-sectional view of a head main body along an IX-IX line in FIG. 1.

As illustrated in FIG. 9, the first attachment part 10 has a circular recess 11 that is recessed from an outer surface 3*a* of the sole part 3, a recess bottom part 12 of the recess 11, and an attachment hole 13 that joins to an inner peripheral edge of the recess bottom part 12 and extends toward interior of the head main body 1A. A female screw 14 is provided on an inner peripheral surface of the attachment hole 13.

The first weight member 7 has substantially a bolt shape that has a circular head part 7*a* and a screw rod part 7*b* that joins to the head part 7*a*. A male screw is provided on an outer peripheral surface of the screw rod part 7*b*. The male screw and the female screw 14 are screwed to other.

In this embodiment, an outer diameter of the head part 7*a* is slightly smaller than the recess 11; a thickness of the head part 7*a* is slightly smaller than a depth of the recess 11; in a state where the first weight member 7 is screwed until the head part 7*a* touches the recess bottom part 12, the entire head part 7*a* is accommodated inside the recess 11 and does not protrude from the outer surface 3*a* of the sole part 3.

A first opening part 15 is formed by a boundary between the recess 11 and the outer surface 3*a*, and a center of the first opening part 15 is a center $C_1$.

In FIG. 9, "r" indicates a radius of the first opening part 15.

Although not illustrated in the drawings, the second attachment part 20 is also similarly provided with a recess, a recess bottom part and an attachment hole. A second opening part 25 is formed by a boundary between the recess and the outer surface of the sole part 3 and a center of the second opening part 25 is a center $C_2$. The second weight member 8 that is attached to the second attachment part 20, similar to the first weight member 7, also has substantially a bolt shape that has a head part 8*a* and a screw rod part (which are not illustrated in the drawings). In this embodiment, in a state where the second weight member 8 is screwed to the second attachment part 20 until the head part 8*a* touches the recess bottom part, the head part 8*a* does not protrude from the outer surface 3*a* of the sole part 3.

In this embodiment, a diameter of the head part 8*a* of the second weight member 8 is larger than the diameter of the head part 7*a* of the first weight member 7. Further, the diameter of the head part 8*a* of the second weight member 8 is larger than the diameter (2×r) of the first opening part 15. However, it is also possible that the first weight member 7 and the second weight member 8 have the same size.

FIG. 1 is a reference plan view of the golf club head 1. A point at which a central axis extension line of the hosel hole 6*a* intersects the sole part 3 is indicated as "P." A point $G_0$ in FIG. 1 indicates a gravity center of the head main body 1A where neither the first weight member 7 nor the second weight member 8 is attached.

In FIG. 1, a straight line passing through the point P and the point $G_0$ is a reference imaginary straight line $L_0$. In FIG. 1, a straight line connecting the point P and the center $C_1$ of the first opening part 15 is a first imaginary straight line $L_1$. A straight line connecting the point P and the center $C_2$ of the second opening part 25 is a second imaginary straight line $L_2$.

The second weight member 8 that is attached to the second attachment part 20 is attached in order to change a gravity center angle of the golf club head 1. On the other hand, the first weight member 7 that is attached to the first attachment part 10 is attached in order to allow a weight of the golf club head 1 to match a target weight. For example, by reducing the weight of the first weight member 7 when the second weight member 8 is too heavy, or increasing the weight of the first weight member when the second weight member 8 is too light, the weight of the golf club head 1 can be caused to match the target weight, while a gravity center angle is changed.

Figure 10:
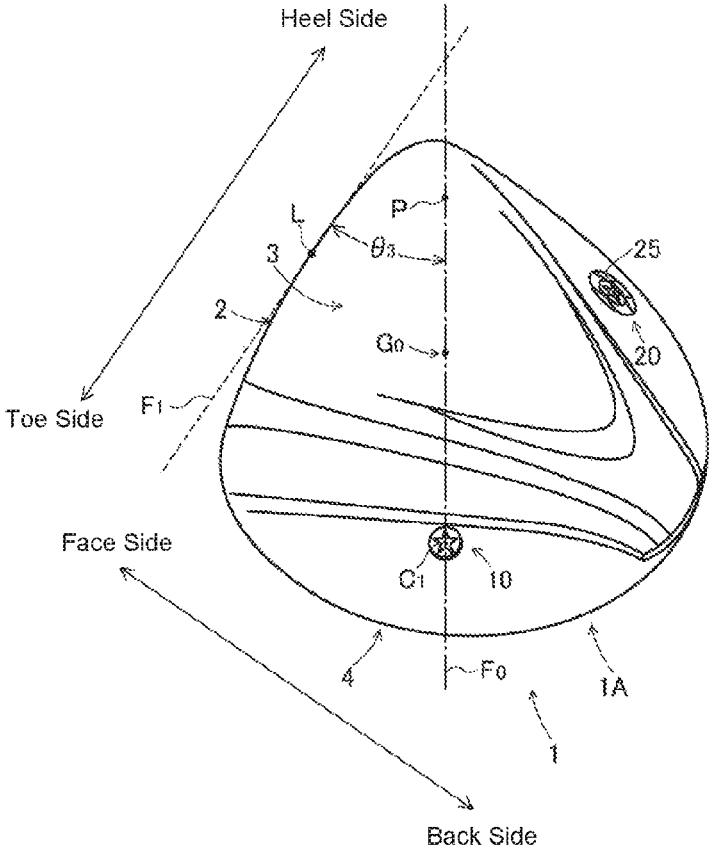
FIG. 10 is an explanatory diagram for describing a gravity center angle.
Figure 11:
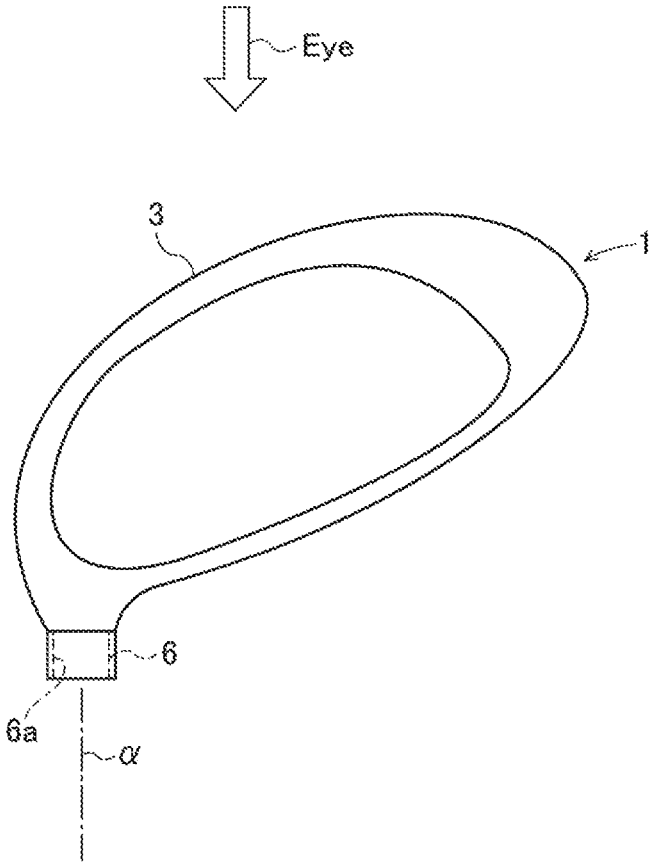
FIG. 11 is an explanatory diagram for describing the reference plan view.

As illustrated in FIG. 10, the gravity center angle is an intersection angle $\theta_3$ between a vertical plane $F_0$, which contains a shaft axial center line, and an imaginary plane $F_1$, which is in contact with a point L, in a state where the shaft of the golf club is horizontally supported rotatable about a shaft axial center and the head is freely suspended from the shaft by its own weight. The point L illustrated here is a point on the most face side in a state where the sole part 3 of the golf club head 1 is set up with specified lie angle and real loft angle, the most face side point being determined on a vertically downward imaginary line drawn from a geometric center of the face part 2, which is a center of the face part 2 in a top-sole direction and toe-heel direction.

Figure 2:
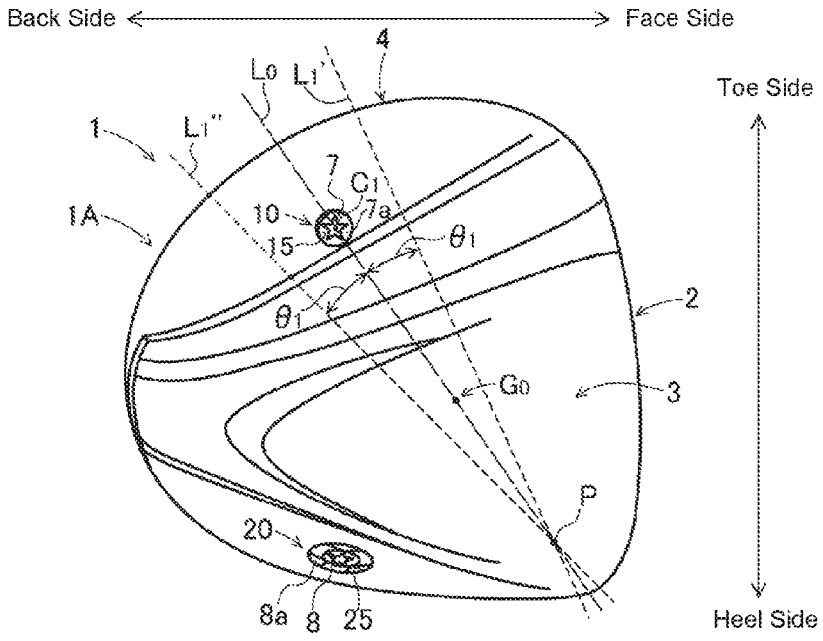
FIG. 2 is a reference plan view of the sole part of the golf club head according to the embodiment.

In the present invention, a first angle $\theta_1$ at which the reference imaginary straight line $L_0$ and the first imaginary straight line $L_1$ intersect is ±10 degrees or less, preferably ±5 degrees or less, and more preferably ±2 degrees or less. In this embodiment, $\theta_1$ is 0 degree. In FIG. 2, a first imaginary straight line $L_1'$ when $\theta_1$ is −10 degrees and a first imaginary straight line $L_1''$ when $\theta_1$ is 10 degrees are illustrated. By setting $\theta_1$ as described above, the change in the gravity center angle due to the first weight member 7 can be suppressed, and the gravity center angle can be changed by the second weight member 8.

Figure 3:
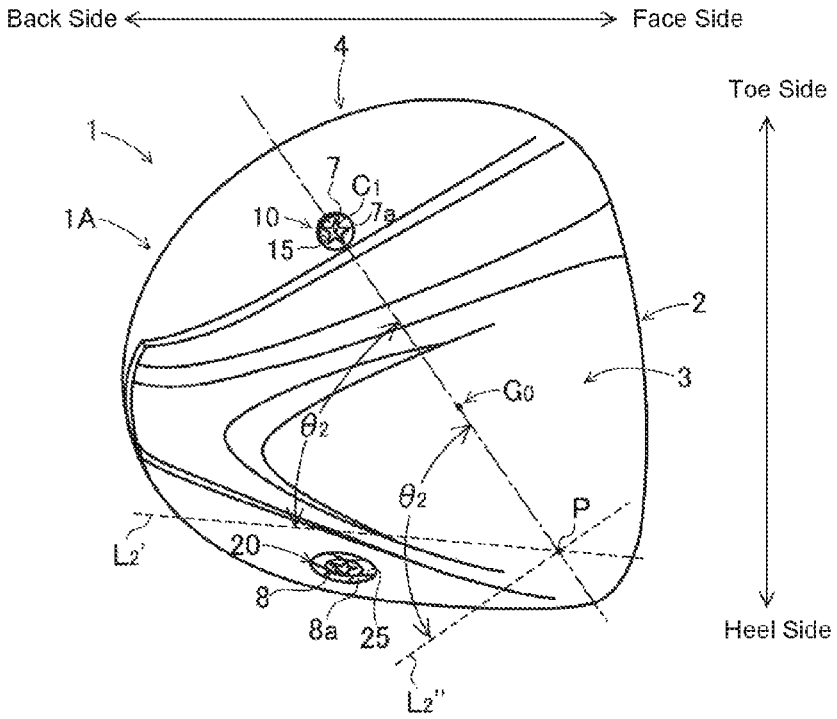
FIG. 3 is a reference plan view of the sole part of the golf club head according to the embodiment.

In the present invention, a second angle $\theta_2$ at which the reference imaginary straight line $L_0$ and the second imaginary straight line $L_2$ intersect is larger than the first angle $\theta_1$. The second angle $\theta_2$ is preferably 50 degrees or more and 90 degrees or less, and more preferably 55 degrees or more and 80 degrees or less. In FIG. 1, $\theta_2$=60 degrees. In FIG. 3, a second imaginary straight line $L_2'$ when $\theta_2$ is 50 and a second imaginary straight line $L_2''$ when $\theta_2$ is 90 degrees are illustrated.

By setting the second angle $\theta_2$ as described above, the gravity center angle can be changed by the second weight member 8 that is attached to the second attachment part 20. When the second angle $\theta_2$ is too small, an amount of change in the gravity center angle is reduced. When the second angle $\theta_2$ is too large, it is unrealistic to arrange the second attachment part 20 in the golf club head.

A weight of the first weight member 7 is not particularly limited. However, the weight of the first weight member 7 is, for example, 0.5 g or more and 30 g or less. In this embodiment, a first weight member 7 having a weight of 2 g and a first weight member 7 having a weight of 8 g are prepared.

A weight of the second weight member 8 is not particularly limited. However, the weight of the second weight member 8 is, for example, 0.5 g or more and 30 g or less. In this embodiment, a second weight member 8 having a weight of 9 g and a second weight member 8 having a weight of 3 g are prepared.

The golf club head 1 has at least two first weight members 7 having different weights and at least two second weight member 8 having different weights. A combination of one first weight member 7 selected from the at least two first weight members 7 having different weights and one second weight member 8 selected from the at least two second weight members 8 having different weights may be referred to as a "pair" in the following.

In the present invention, at least two pairs have the same weight. Here, the meaning of that the weights are the same may also include that the weights are slightly different, such as that the weights are different by ±1 g or less. One reason for this is that a slight difference in weight between the weight members occurs in manufacturing. In this embodiment, the first weight member 7 having the weight of 2 g and the second weight member 8 having the weight of 9 g form a pair I, which has a pair I weight of 11 g; and the first weight member 7 having the weight of 8 g and the second weight member 8 having the weight of 3 g form a pair II, which has a pair II weight of 11 g. That is, no matter which one of the pair I and the pair II is attached to the golf club head 1, the weight of the golf club head 1 is the same. In this embodiment, there is only one kind of the pair weight, which is 11 g. However, it is also possible to prepare the first weight members 7 and the second weight members 8 such that there are two or more kinds of pair weights. This allows golf club heads 1 having different weights to be prepared.

Figure 4:
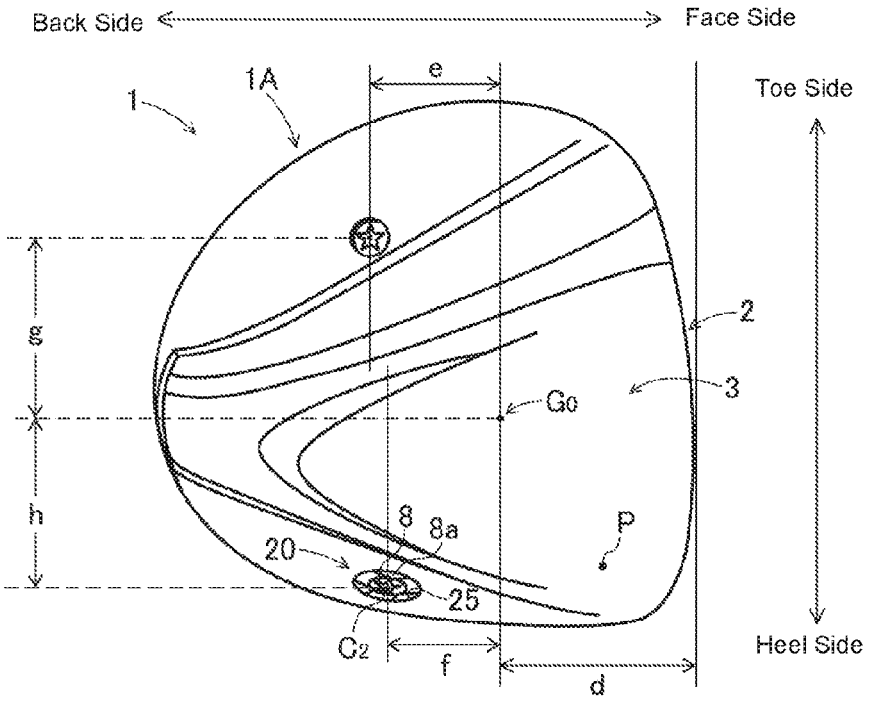
FIG. 4 is a reference plan view of the sole part of the golf club head according to the embodiment.
Figure 5:
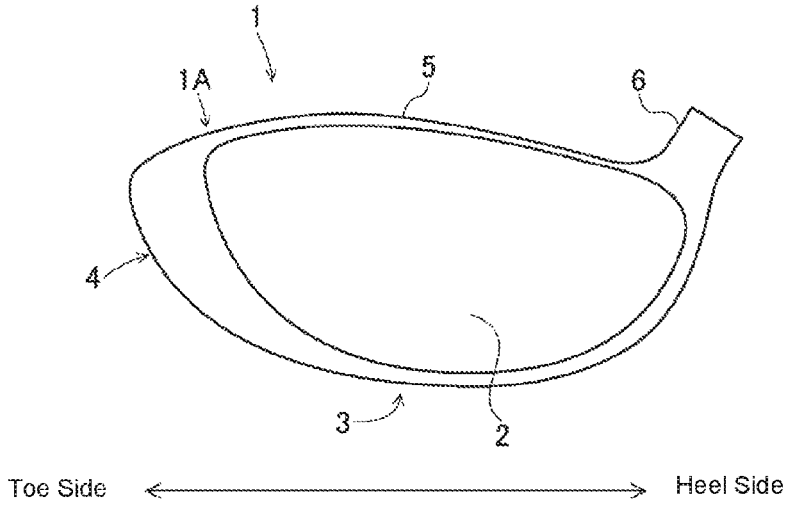
FIG. 5 is a front view of the golf club head according to the embodiment.
Figure 6:
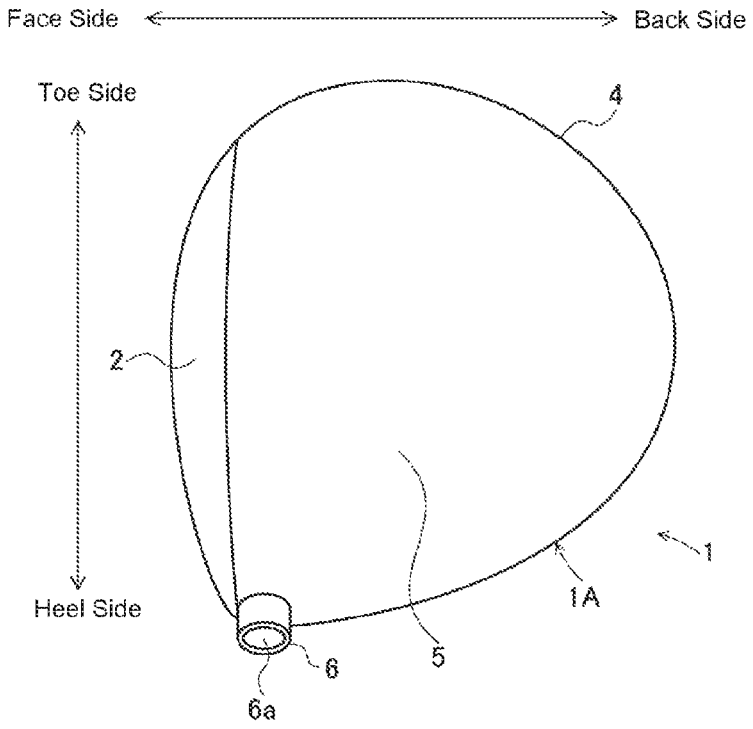
FIG. 6 is a top view of the golf club head according to the embodiment.
Figure 7:
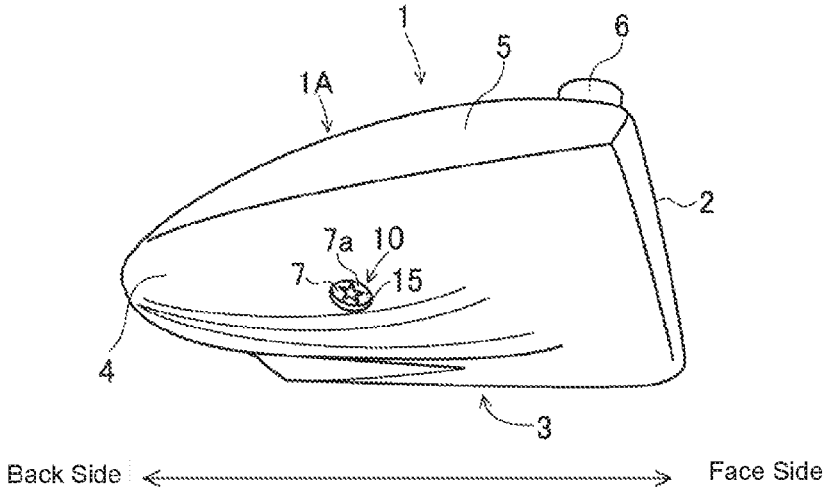
FIG. 7 is a side view viewed from a toe side of the golf club head according to the embodiment.
Figure 8:
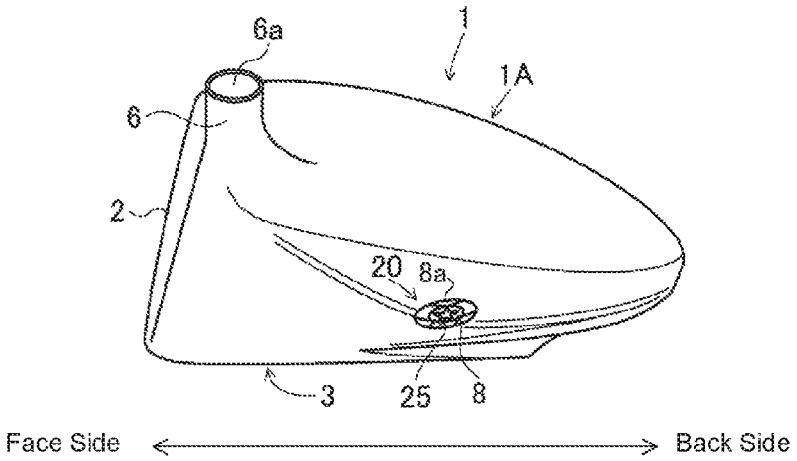
FIG. 8 is a side view viewed from a heel side of the golf club head according to the embodiment.

In FIG. 4, in a reference plan view, a distance e in a face-back direction from the gravity center $G_0$ to the center $C_1$ of the first opening part 15 is illustrated. Although not particularly limited, the distance e is, for example, 5 mm or more and 45 mm or less. In this embodiment, the distance e is 25 mm.

A distance fin the face-back direction from the gravity center $G_0$ to the center $C_2$ of the second opening part 25 is not particularly limited. However, for example, the distance f is 5 mm or more and 45 mm or less. In this embodiment, the distance f is 22 mm.

Further, a distance g in a toe-heel direction from the gravity center $G_0$ to the center $C_1$ of the first opening part 15 is not particularly limited. However, for example, the distance g is 5 mm or more and 50 mm or less. In this embodiment, the distance g is 35 mm.

A distance h in the toe-heel direction from the gravity center $G_0$ to the center $C_2$ of the second opening part 25 is not particularly limited. However, for example, the distance h is 5 mm or more and 40 mm or less. In this embodiment, the distance h is 33 mm.

By setting (e-f) to 15 mm or less, particularly 5 mm or less and setting (g-h) to 15 mm or less, particularly 5 mm or less, even when weight members having different weights are replaced, a change in a gravity center depth of the golf club head 1 can be suppressed. That is, the gravity center angle can be changed while the change in the gravity center depth of the golf club head 1 is suppressed.

Here, as illustrated in FIG. 4, in a reference plan view, the gravity center depth of the golf club head 1 is a distance d in the face-back direction from the position on the most face side to the gravity center $G_0$.

The above description illustrates an example of the present invention, and the present invention may have a configuration other than that described above.

The present invention can also be applied to a head of a fairway wood or a utility club other than a driver.

What is claimed is:

1. A golf club head, comprising:

a head main body that includes:

a hosel hole;

a first attachment part that has a first opening part for allowing a weight member to be removably attached thereto; and a second attachment part that has a second opening part for allowing a weight member to be removably attached thereto;

two or more of first weight members that have different weights and can each be attached to the first attachment part; and two or more of second weight members that have different weights and can each be attached to the second attachment part, wherein there are two or more combinations each of which includes one of the first weight members and one of the second weight members, and has the same total weight, assuming reference plan view in which the golf club head is viewed downward from a position vertically above the golf club head under a condition where a sole part faces upward and a hosel hole central axis extension line is vertical, a reference imaginary straight line, a first imaginary straight line and a second imaginary straight line are set with respect to the reference plan view, the reference imaginary straight line passing through a central axis of the hosel hole and a head gravity center that is determined when neither the first weight members nor the second weight members are attached to the head main body, the first imaginary straight line passing through the central axis of the hosel hole and a center of the first opening part, and the second imaginary straight line passing through the central axis of the hosel hole and a center of the second opening part, a first angle $\theta_1$ between the reference imaginary straight line and the first imaginary straight line is ±10 degrees or less, and a second angle $\theta_2$ between the reference imaginary straight line and the second imaginary straight line is larger than the first angle $\theta_1$.

2. The golf club head according to claim 1, wherein the second angle $\theta_2$ is 50 degrees or more and 90 degrees or less.

3. The golf club head according to claim 2, wherein a difference (e-f) between distance (e) and distance (f) is 15 mm or less, the distance (e) being defined as, in a face-back direction of the head main body, from the head gravity center to the center of the first opening part and the distance (f) being defined as, in the face-back direction, from the head gravity center to the center of the second opening part, and a difference (g-h) between distance (g) and distance (h) is 15 mm or less, the distance (g) being defined as, in a toe-heel direction of the head main body, from the head gravity center to the center of the first opening part and the distance (h) being defined as, in the toe-heel direction, from the head gravity center to the center of the second opening part.

4. The golf club head according to claim 2, wherein the second angle $\theta_2$ is 55 degrees or more and 80 degrees or less.

5. The golf club head according to claim 1, wherein a difference (e-f) between distance (e) and distance (f) is 15 mm or less, the distance (e) being defined as, in a face-back direction of the head main body, from the head gravity center to the center of the first opening part and the distance (f) being defined as, in the face-back direction, from the head gravity center to the center of the second opening part, and a difference (g-h) between distance (g) and distance (h) is 15 mm or less, the distance (g) being defined as, in a toe-heel direction of the head main body, from the head gravity center to the center of the first opening part and the distance (h) being defined as, in the toe-heel direction, from the head gravity center to the center of the second opening part.

6. The golf club head according to claim 1, wherein the first angle $\theta_1$ is ±5 degrees or less.

7. The golf club head according to claim 6, wherein the first angle $\theta_1$ is ±2 degrees or less.

8. The golf club head according to claim 1, wherein each of the first and second weight members has a head part, and a diameter of the head part of the second weight member is larger than a diameter of the head part of the first weight member.

* * * * *